US006385432B1

(12) United States Patent
Hanazato et al.

(10) Patent No.: US 6,385,432 B1
(45) Date of Patent: May 7, 2002

(54) METHOD OF CONTROLLING POST-PROCESSOR CONNECTED WITH IMAGE-FORMING DEVICE

(75) Inventors: Eiichi Hanazato; Takashi Inui; Yoshinori Wada, all of Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/693,895

(22) Filed: Oct. 23, 2000

(30) Foreign Application Priority Data

Apr. 20, 2000 (JP) ..... 2000-120139

(51) Int. Cl.[7] ..... G03G 15/00
(52) U.S. Cl. ..... 399/384; 399/407
(58) Field of Search ..... 399/384, 385, 399/387, 388, 397, 407, 408, 409, 410; 271/264, 270

(56) References Cited

U.S. PATENT DOCUMENTS

| | | | | |
|---|---|---|---|---|
| 3,994,487 A | | 11/1976 | Wicklund | |
| 4,091,978 A | * | 5/1978 | Graham, II | |
| 4,891,681 A | * | 1/1990 | Fiske et al. | 399/385 |
| 5,061,967 A | * | 10/1991 | Isobe | 399/385 X |
| 5,063,416 A | * | 11/1991 | Honda et al. | 399/384 |
| 5,296,906 A | * | 3/1994 | Hano et al. | 399/385 |
| 6,188,853 B1 | * | 2/2001 | Ishida et al. | 399/384 X |

FOREIGN PATENT DOCUMENTS

| | | |
|---|---|---|
| JP | 52-58615 | 5/1977 |
| JP | 6-227720 | 8/1994 |
| JP | 10-17185 | 1/1998 |
| JP | 2000-147841 | 5/2000 |
| JP | 2000-224895 | 8/2000 |

* cited by examiner

*Primary Examiner*—Sandra Brase
(74) *Attorney, Agent, or Firm*—Armstrong, Westerman, & Hattori, LLP

(57) ABSTRACT

The present invention aims at providing a method of controlling a post-processor connected with an image-forming device that utilizes a conventional image-forming device and post-processing unit, and does not necessarily require to consistently form a sag in continuous paper. The inventive method of controlling the post-processor is carried out by the image-forming device that includes a transfer part and a fixing part, and conveys continuous paper. The image-forming device is connected with the post-processor that processed the continuous paper on which an image has been formed. The method comprises the steps of initiating an electrophotographic image-forming operation in the transfer part and the fixing part so that the image-forming device forms an image onto and conveys the continuous paper, initiating an operation of the post-processor so that the post-processor post-processes and conveys the continuous paper, stopping the operation of the post-processor on or before a completion of a transfer by the transfer part onto the continuous paper, conveying to the fixing part the continuous paper onto which the fixing part has finished transferring, and conveying to the transfer part the continuous paper onto which the fixing part finishes a fixation.

11 Claims, 7 Drawing Sheets

METHOD OF CONTROLLING POST-PROCESSOR CONNECTED WITH IMAGE-FORMING DEVICE

BACKGROUND OF THE INVENTION

The present invention relates generally to electrophotographic image-forming devices, and more particularly to a method of controlling a post-processor that handles continuous paper printed by an electrophotographic image-forming device.

The present invention is suitable, for example, for an output device for use with a computer system that needs to print large amounts of data.

Hereupon, the "electrophotographic image-forming device" by which we mean is an image-forming device employing the Carlson process described in U.S. Pat. No. 2,297,691, and denotes a nonimpact printer that provides recording by depositing a developer as a recording material on a recordable medium (continuous paper in the present invention). The "continuous paper" includes fanfold paper and paper in rolls, and denotes a recordable medium that permits a user's discretionary setting of a recording length. The width of the continuous paper is determined by selecting a type of paper to be used, as necessary, from several types of ready-made paper that have a standardized or predetermined width.

The "post-processor" is a device that carries out one or more of various operations such as cutting, sorting, stapling, etc. after recording on the continuous paper. Characteristically, the post-processor is connected with an image-forming device, and carries out an operation under the control of the image-forming device as a host processor.

In recent years, the electrophotographic image-forming device (continuous paper printer) that uses continuous paper as a recordable medium for printing large amounts of data is typically connected with the post-processor that automatically carries out one or more of various operations such as folding, cutting, sorting, and stapling for the continuous paper. The electrophotographic continuous paper printer, which generally uses a photoconductive insulator (e.g., photosensitive drum, and photosensitive belt), follows the procedural steps of charging, exposure to light, development, and transfer, and the process further includes the fixing step for the continuous paper after the transfer step.

The charging step uniformly electrifies the photosensitive drum (e.g., at −700V). The exposure step irradiates a laser beam or the like on the photosensitive drum, and changes the electrical potential at the irradiated area down, for example, to −50V or so, forming an electrostatic latent image. The development step electrically deposits a developer onto the photosensitive drum using, for example, the reversal process, and visualizes the electrostatic latent image. The transfer step forms a toner image corresponding to the electrostatic latent image on a recordable medium using a transfer unit. The fixing step fuses and fixes the toner image on the medium by the application of heat or pressure, or light irradiation by a fixing unit, thereby obtaining a printed matter.

Conventionally, one printing operation in the continuous paper printer that forms an image on the continuous paper is defined as a process going on after a toner image is transferred from the photosensitive drum to the continuous paper until the fixing unit fixes the toner image. When a print command for one job has been finished, and a subsequent print command for the next job has not been received, the continuous paper on which the last line is printed is at a standstill on a continuous paper feed path in the continuous paper printer. To be more specific, the paper feed stops immediately after the last line has passed through the fixing unit. However, when the command for the next job is issued in this situation, and the printing starts, a blank area in which no image is formed is produced between the last line of the image printed by the immediately preceding job, and the first line of the image to be printed by the next job on the continuous paper. This would waste the continuous paper with a length corresponding to a distance from the fixing unit to a transfer position, and thus impair the use efficiency of the continuous paper. Therefore, a so-called reverse feed has conventionally been carried out that moves back the continuous paper by a specific length when a print command for one job is completed, and no print command for the next job comes. This would improve the use efficiency of the continuous paper.

To give another example, a continuous paper printer that includes first and second image-forming parts, and sequentially records images on both sides of the continuous paper forms the images in each image-forming part spaced out due to mechanical requirements. To be specific, the two-sided printer forms images by following the steps of a transfer on a first side of paper by a first image-forming part, a transfer on a second side of paper by a second image-forming part, a fixing on the first side of paper by the first image-forming part, and a fixing on the second side of paper by the second image-forming part in this sequence. In order to improve the use efficiency of continuous paper in the printer configured as above, the reverse feed amount of the continuous paper (distance at which the continuous paper is conveyed in a backward direction) is configured to be larger than that in a single-side printer.

The post-processor is electrically connected with the continuous paper printer, and carries out operations such as cutting of the continuous paper conveyed. Following is an exemplified post-processor embodied as a burster unit that separates the continuous paper along perforations into individual sheets. The burster unit upon startup of the printing operation simultaneously starts separation of the continuous paper conveyed; thus, the continuous paper has already been separated when the reverse feed is to be carried out in the continuous paper printer, and cannot be conveyed in a reverse direction. Therefore, if the post-processor having no reverse feed capability is connected with the continuous paper printer having a reverse feed capability, the feed of the continuous paper is controlled so that a reverse feed amount of the continuous paper may sag during printing. In addition, the post-processor is manufactured by a maker other than that of the continuous paper printer in many occasions, and thus may be selected among post-processors capable of accepting a specific post-processing command from the continuous paper printer.

A further detailed description will be given of the method of controlling the post-processor with reference to FIG. 9. FIG. 9 is a flowchart showing a conventional method of controlling printing operations for explaining the method of controlling the post-processor, where the reverse feed amount (distance from the transfer part to the fixing part) is 50 inches. First, for example, when a print command for one job is issued from a host device such as a computer (step 2), the continuous paper printer receives the command to initiate printing (step 4). Subsequently, the image-forming device, which has experimentally worked out the time required to feed continuous paper over a predetermined distance of 50 inches in advance, sets a timer for that time (step 6). The image-forming device then initiates the operation, and does printing as intended on the continuous paper (step 8). During the printing operation, if the timer exceeds the set time and indicates zero (step 10), the image-forming device, construing it to mean that a 50-inch sag has been formed in the continuous paper, transmits a signal to initiate an operation to the post-processor. Until the timer indicates zero (step 10), the printing operation continues all the way, and the signal to initiate the operation is not transmitted to the post-processor. The post-processor eventually receives the command to initiate the operation, and initiate the operation (e.g., of cutting the continuous paper) (step 12). If the intended printing operation is completed, the paper feed stops immediately after the last line of the image on the continuous paper has passed through the fixing part. At that moment, the image-forming device and post-processor simultaneously stops the operations. Thereafter, a feeder unit in the image-forming device initiates an operation, and carries out a reverse feed for a distance of 50 inches to get ready for the print command for the next job. The intended printing based upon the command from the host device is then completed (step 14). As has been described above, the printing operation for the continuous paper repeats a series of these procedural steps.

However, since a sag the amount of which corresponds to the reverse feed amount is continuously provided in the continuous paper while the printing operation is carried out according to the conventional method, if the image-forming device of which the reverse feed amount is large is used, or if there is a difference in processing speed between the continuous paper printer and the post-processor, and the former is faster than the latter, then part of the continuous paper comes in contact with the floor between the image-forming device and the post-processor. Consequently, the printed surface of the continuous paper and the floor rubs together, and disadvantageously disturbs an image or smears the printed surface. In order to provide a means for avoiding this problem, a saucer made of sheet metal or the like is placed on the floor so that the continuous paper ejected from the image-forming device may not get in direct contact with the floor. Nonetheless, the printed continuous paper is constantly in contact with and rubbed against the saucer during the printing operation, and thus there exists high possibilities that the image quality would lower, the continuous paper would smear, and the other problems would occur. In addition, the large amount of the sag in the continuous paper would disadvantageously increase the effect of the wind from outside, or the like, and prevent a stable movement of the continuous paper, thereby producing a jam in the post-processor.

There is a method of removing an excess sag in the continuous paper, in which the continuous paper is not brought into contact with the floor due to a mechanical buffer mechanism provided for a sagged portion in the continuous paper. However, the method would disadvantageously result in increased costs for providing the buffer mechanism. Another method of avoiding the sag problem is conceivable, in which the post-processor is also provided with the reverse feed mechanism, but the continuous paper that has already undergone the post-process such as cutting cannot be conveyed in the reverse direction, and therefore the current practice adopts the aforementioned controlling method at the same time to avoid the problem.

BRIEF SUMMARY OF THE INVENTION

Accordingly, it is an exemplified general object of the present invention to provide a novel and useful post-processor connectible with an image-forming device in which the above disadvantages are eliminated.

Another exemplified and more specific object of the present invention is to provide a method of controlling a post processor connectible with an image forming device that utilizes a conventional image-forming device and post-processor, and dispenses with a sag to be formed in continuous paper all the time during printing operation.

In order to achieve the above objects, a method of controlling a post-processor as one exemplified embodiment of the present invention is carried out by an image-forming device that includes a transfer part and a fixing part, and conveys continuous paper. The image-forming device is connected with the post-processor that carries out processing on continuous paper on which an image has been formed. This method comprises the steps of initiating an electrophotographic image-forming operation in the transfer part and the fixing part so that the image-forming device forms an image onto and conveys the continuous paper, initiating an operation of the post-processor so that the post-processor post-processes and conveys the continuous paper, stopping the operation of the post-processor on or before completion of a transfer by the transfer part onto the continuous paper, conveying to the fixing part the continuous paper onto which the transfer part has finished transferring, and conveying to the transfer part the continuous paper onto which the fixing part finishes a fixation. According to this control method, the continuous paper is conveyed from the transfer part to the fixing part after the operation of the post-processor has stopped, to provide a sag in the continuous paper between the image-forming device and the post-processor, and thus is prevented from being cut off even if the continuous paper is conveyed in a reverse direction from the fixing part to the transfer part to get ready for a print command for the next job.

An image-forming device as one exemplified embodiment of the present invention in order to achieve the above objects is an electrophotographic image-forming device comprises a mechanical controller which controls a printing mechanism that forms an image, and a conveyor mechanism that conveys a continuous paper, and a main controller that controls the mechanical controller. The main controller controls the mechanical controller so as to generate a signal for stopping a conveyance by a post-processor connected with the image-forming device a specified time before the conveyor mechanism stops. This image-forming device may generate the signal for stopping the conveyance of the post-processor prior to stopping a conveyance mechanism of the image-forming device, and thus be connected with and control the post-processor without any changes such as an addition of parts or modification to a conventional post-processor.

Other objects and further features of the present invention will become readily apparent from the following description of the embodiments with reference to accompanying drawings.

DETAILED DESCRIPTION OF THE INVENTION

Figure 1:
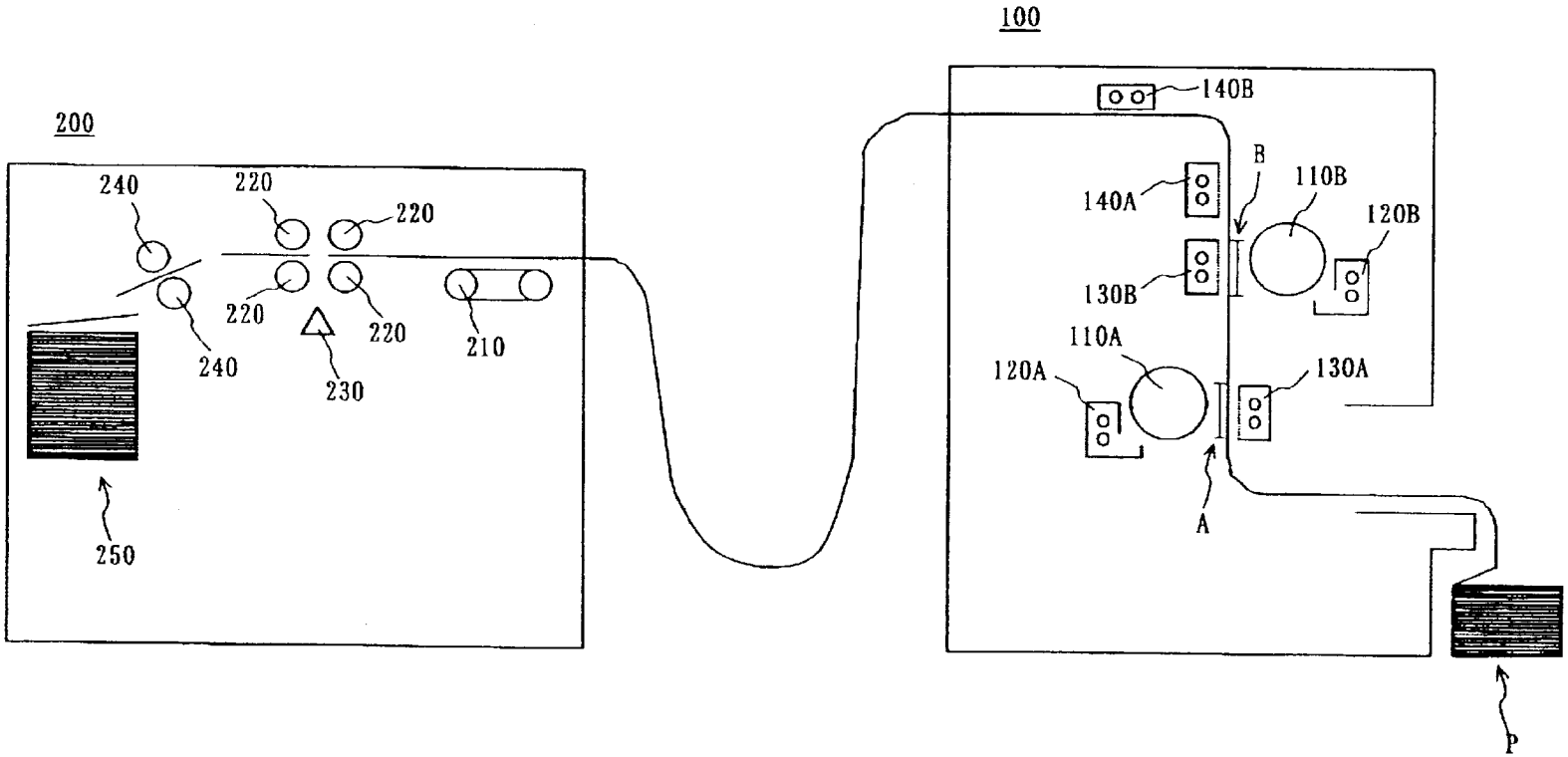
FIG. 1 is a schematic sectional view of principal part as a structural illustration of an image-forming device and a post-processor.

Referring now to FIGS. 1 to 6 inclusive, a description will be given of a method of controlling a post-processor 200 connected with an image-forming device 100 according to the present invention. In each figure, those elements designated by the same reference numerals denote the same elements, and a duplicate description thereof will be omitted. FIG. 1 is a schematic sectional view of principal part as a structural illustration of the image-forming device 100 and the post-processor 200, in which some components provided in the actual image-forming device 100 are partially omitted or diagrammatically illustrated for the purpose of explaining a feeding operation of continuous paper P. The image-forming device 100 includes two sets of image-forming parts, which make it possible to form images on both sides of the continuous paper P.

In the present invention, the image-forming device 100 is embodied as a continuous paper (two-sided) printer 100, and the post-processor as a burster unit 200 for illustration purposes. The continuous paper printer 100 includes photosensitive drums 110A and 110B, development units 120A and 120B, transfer units 130A and 130B, and fixing units 140A and 140B. Hereinafter, reference numerals without an alphabet comprehensively indicate the elements designated by the same reference numerals with an alphabet attached thereto, unless otherwise specified.

The photosensitive drum 110 structurally has a photosensitive dielectric layer on a rotatable drum-shaped conductive support, and may be uniformly charged by a charger (not shown). For example, the photosensitive drum 110 is an OPC or an aluminum drum to which a separated function organic photosensitive body is applied at a thickness of approximately 20 $\mu$m, and the external diameter, for instance, of 20 mm, and rotates at a circumferential velocity of 90 mm/s in an arrow direction. The photosensitive drum 110 is exposed to light by an exposure unit (not shown), and a potential in a charged area on the photosensitive drum 110 is neutralized, whereby a latent image corresponding to image data for an image to be recorded is formed.

The development unit 120 supplies toner onto the photosensitive drum 110, and forms a toner image on the photosensitive drum 110, visualizing the latent image. The toner is usable no matter whether it is monocomponent toner or dual-component toner (i.e., including a carrier).

The fixing unit 130 generates an electric field that serves to electrostatically adsorb toner. The toner image on the photosensitive drum 110 is electrostatically adsorbed to the continuous paper P using a transfer current, deposited thereon, and eventually transferred thereto. As shown in FIG. 1, the transfer unit 130 disposed opposite the photosensitive drum 110 with respect to the continuous paper P. According to this structure, the continuous paper printer 100 that prints on both sides of the continuous paper P has a transfer position A at which the transfer step is carried out with the photosensitive drum 100A and the transfer unit 130A, and a transfer position B at which the transfer step is carried out with the photosensitive drum 110B and the transfer unit 130B, displaced from each other along a conveyor path of the continuous paper P.

The fixing unit 140 is a device that fuses the toner into the continuous paper P. The toner that has been transferred is electrostatically adhered onto the continuous paper P, and thus easily flaked off. Therefore, the toner is fixed utilizing energy such as pressure and heat, and it is necessary to transform solid toner into a liquid state in order to acquire a sufficient fixing capability. Providing the energy makes the solid toner sinter, spread, and penetrate, thereafter putting the fixing process to an end. As described above, the transfer positions A and B are displaced from each other, and accordingly, the fixing units 140A and 140B displaced from each other by the same distance.

To illustrate an operation of the continuous paper printer 100 shown in FIG. 1, in the first place, the photosensitive drum 110 is uniformly negatively charged (e.g., at −700V) by the charger (not shown). When a light is irradiated on the photosensitive drum 110 from the exposure unit (not shown), the uniform charge at the irradiated area on the photosensitive drum 110 corresponding to an original image is eliminated through the exposure to light, and a latent image is formed. The development unit 120 then develops the latent image. To be specific, the toner as a charged particle (or powder) bearing the electric charge of approximately −50 V is attracted using static electricity onto the area where the uniform charge is eliminated on the photosensitive drum 110. As a result, the latent image on the photosensitive drum 110 is visualized into a toner image.

Subsequently, the toner image on the photosensitive drum 110A is transferred first at the transfer position A on a first surface of the continuous paper P that is being conveyed in the transfer unit 130A. Then, when the toner image on the first surface arrives at the transfer position B, the toner image on the photosensitive drum 110B is transferred at the transfer position B on a second surface of the continuous paper P in the transfer unit 130B. In this way, the transfer step is carried out with a specific time lag placed between operations on the first and second surfaces when the two-sided printing is done, and the time lag is controlled so as to make the toner images formed in register on the first and second surfaces of the continuous paper P. The first and second surfaces are herein assigned so that the first surface is a back, and the second surface is a front.

Residual toner on the photosensitive drums 110A and 110B is respectively collected using a cleaning unit (not shown). Thereafter, the toner on the first surface of the continuous paper P and the toner on the second surface of the continuous paper P are fixed respectively in the fixing unit 140A, and the fixing unit 140B, with the same time lag as in the transfer step, and are both fixed permanently. During printing operation, a front edge of the continuous paper P on both sides of which printing has been done is dispensed out of the continuous paper printer 100, and conveyed to the burster unit 200.

The continuous paper printer 100 continuously carries out the printing operation if a subsequent print command for the next job has been received when a print command for one job has been finished. However, if no print command for the next job has arrived then, the continuous paper printer 100 conveys the continuous paper P from the transfer unit 130B to the fixing unit 140B, fixes the toner image thereon, and thereafter, carries out a reverse feed until the last line of the image printed in the previous job reaches a position immediately before the transfer position A, to get ready for the print command for the next job.

Referring now to FIG. 1 again, a description will be given of a structure of the burster unit 200. The burster unit 200 includes a feed roller 210, burst rollers 220, a burst cutter 230, conveyor rollers 240, and a stacker 250.

The feed roller 210 feeds the continuous paper P to a cutting position, while eliminating a warp and a kink generated by a sag in the continuous paper P. At that moment, sprocket-engaging apertures provided on both edges of the continuous paper P are cut off using a both-end slitter (not shown). Therefore, the continuous paper P is conveyed in the burster unit 200 utilizing a roller, or the like having large frictional resistance.

The burst rollers 220 are located on both sides of the continuous paper P, and give a tension when cutting the same. Between the burst rollers 220 is provided the burst cutter 230 that cuts the continuous paper P in a direction orthogonal to a traveling direction of the continuous paper P. The continuous paper P that has been cut into a specific unit length is conveyed to the stacker 250 by the conveyor roller 240.

The continuous paper P includes fanfold paper and paper in rolls, and denotes a recordable medium that permits a user's discretionary setting of a recording length. At both edges of the continuous paper P in the present embodiment is formed sprocket-engaging apertures, which are engaged with tractor pins for conveying the continuous paper P in the continuous paper printer 100, and the continuous paper P is thereby conveyed in the continuous paper printer 100. The width of the continuous paper P to be used is selected, as necessary, among those of ready-made paper that have a standardized or predetermined width. There are two types of the continuous paper P: one in which perforations are formed, and the separation is carried out by pressurizing the perforations; and the other in which the separation is carried out by a cutter equipped in the post-processor 200.

Figure 2:
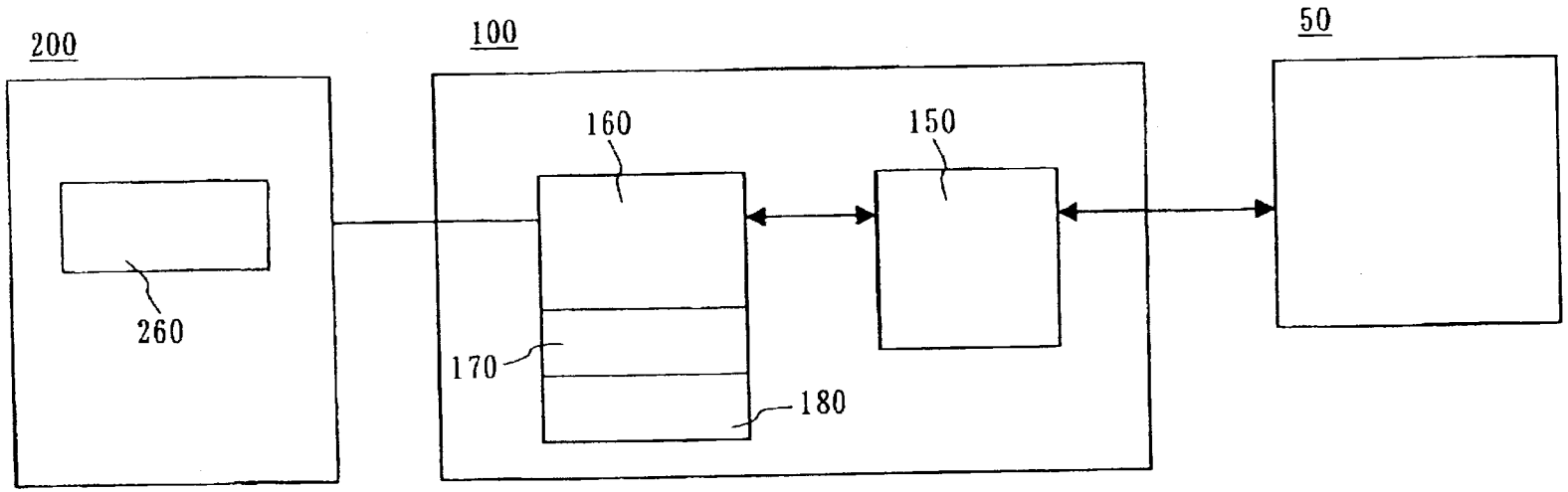
FIG. 2 is a block diagram for explaining the principle of the present invention.
Figure 3:
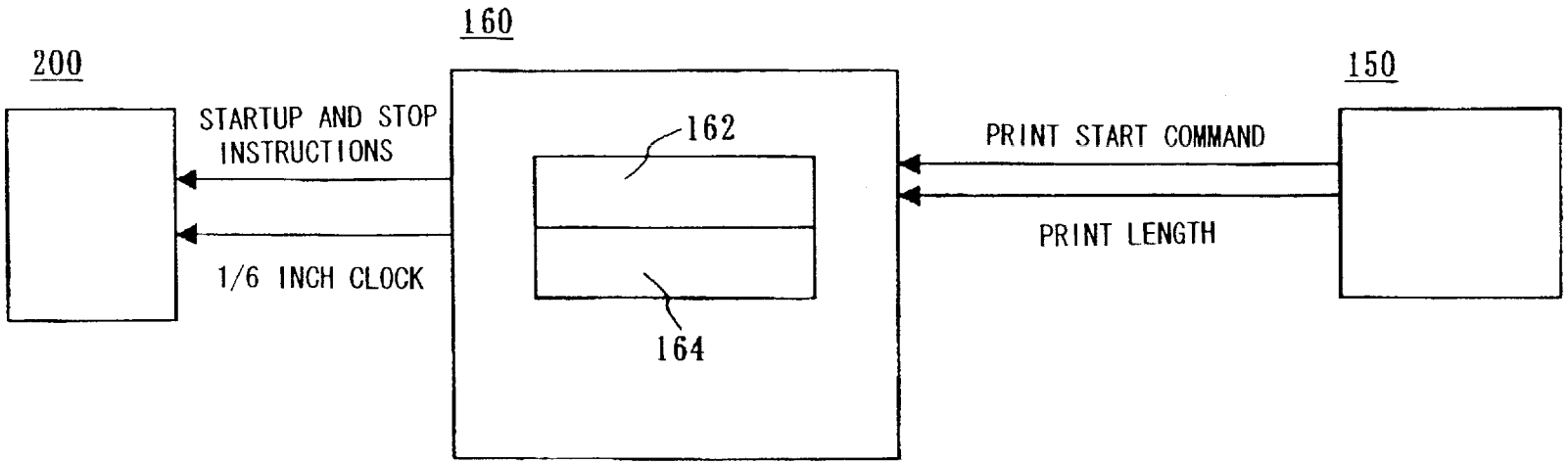
FIG. 3 is a block diagram for explaining the controlling principle of a burster unit.

Referring now to FIGS. 2 and 3, a description will be given of the principle of the present invention. FIG. 2 is a block diagram for explaining the principle of the present invention. FIG. 3 is a block diagram for explaining the controlling principle of the burster unit 200. According to the present invention, as shown in FIG. 2, a host device 50, a continuous paper printer 100, and a burster unit 200 constitutes a printer unit. The host device 50 is comprised of a host computer or the like, and serves as a device in which a user may directly issue a command.

The continuous paper printer 100 includes a controller 150, a mechanical controller 160, a printing mechanism 170, and a conveyor mechanism 180. The controller 150, which is connected with the host device 50, receives a print command and printing data from the host device 50, and transmits a variety of printing process results to the host device 50. The mechanical controller 160 controls under the control of the controller 150 the printing mechanism 170 of the continuous paper printer 100 including the photosensitive drum 110, the development unit 120, the transfer unit 130, the fixing unit 140, and the like as shown in FIG. 1. Although the present embodiment has the control capabilities of the continuous paper printer 100 separated into the controller 150 and the mechanical controller 160 each having an independent MPU, the continuous paper printer 100 may be configured to include only one controller having one MPU. The mechanical controller 160 also controls the burster unit 200. The printing mechanism 170, which includes a series of printing operation processes, receives an instruction from the mechanical controller 160, and carries out the printing operation. The conveyor mechanism 180 receives an instruction from the mechanical controller 160, and conveys the continuous paper P.

The burster unit 200 includes a post-processing mechanism 260. As shown in FIG. 3, the controller 150 in the continuous paper printer 100 provides a print start command and a print length instruction to the mechanical controller 160. In response to the instruction, the mechanical controller 160 starts operating a print length storage memory 162 and a ⅙-inch interrupt circuit 164. The "print length" indicates a size of the image to be printed, and the "print length storage memory" is a memory for storing information of the print length converted from a specified image size. In the present embodiment, the print length corresponding to 1 inch is indicated by 60 in print length, and is measured in units of ⅙ inch (equivalent of 10 in print length); thus 11 inches is represented by 660 in print length. The units for measuring the print length is not limited to ⅙ inch, but may be selected from ½ inch, and ⅓ inch. Accordingly, the "⅙-inch interrupt circuit 164" is provided to serve the purpose of checking images formed on the continuous paper P being conveyed during printing operation every ⅙ inch. The ⅙-inch interrupt circuit 164 is used to control standstill time of the burster unit 200 in synchronism with a ⅙-inch clock.

The mechanical controller 160 also provides a start and stop instruction to the burster unit 200 or the post-processing mechanism 260. The burster unit 200 that has received the instruction feeds, cuts, and stores the continuous paper P. The mechanical controller 160 also provides an instruction to the ⅙-inch clock. The "⅙-inch clock" tells necessary time to feed the continuous paper P by ⅙ inch, and carries out a ⅙-inch interrupt service at the time periods. The ⅙-inch interrupt service is used to perform subtractions for the print length stored in the print length storage memory 162, and can control the standstill time of the burster unit 200.

As above, the method of controlling the post-processor 200 in the present invention may utilize a conventional image-forming device and post-processor as is without any alterations or modifications. The inventive control method may thus be easily introduced to the conventional image-forming device 100. In addition, the inventive method may measure the image size in a specific unit as a print length, and thus easily accommodate and cope with changes in the reverse feed amount.

Figure 4:
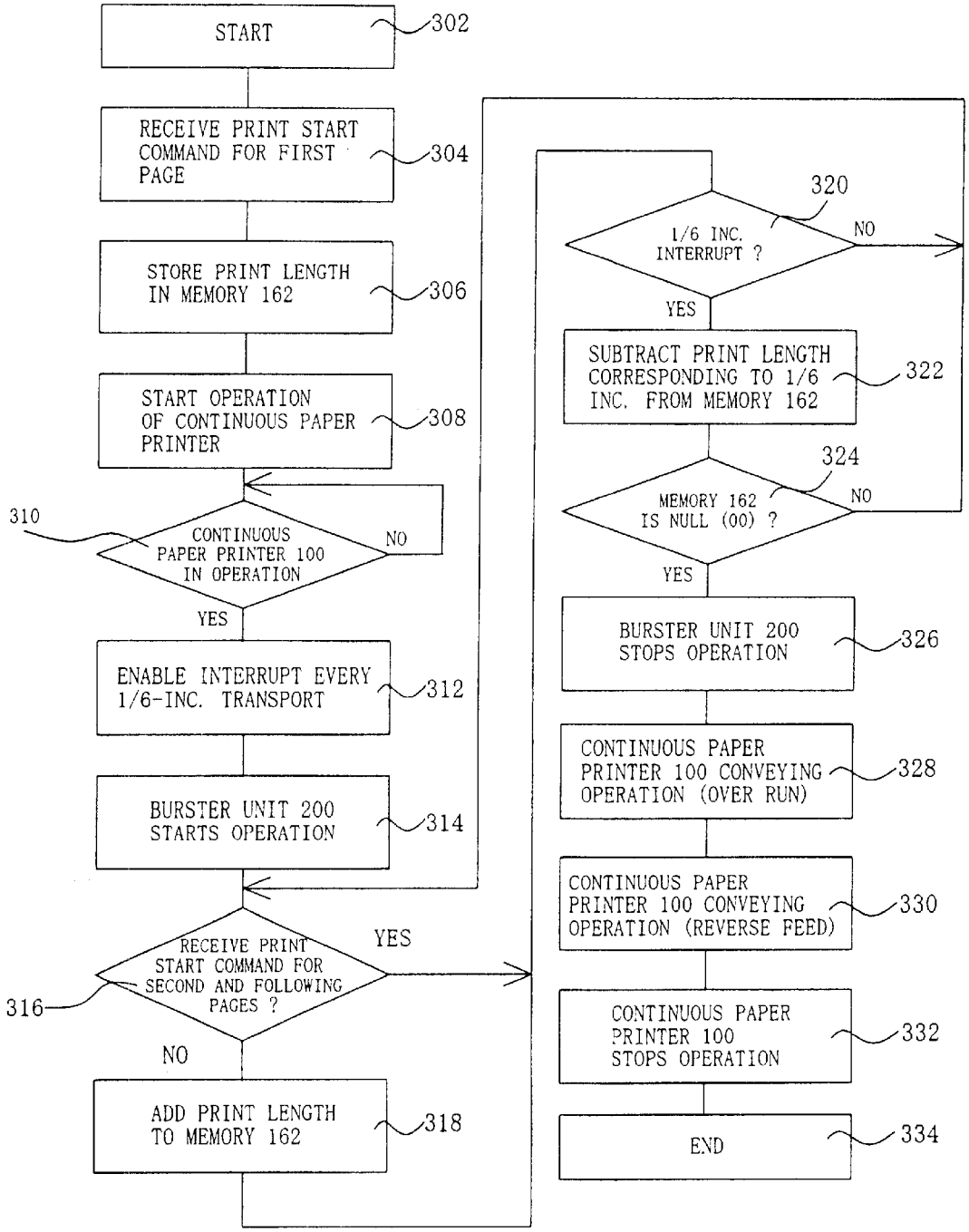
FIG. 4 is a flowchart for explaining a method of controlling the burster unit.
Figure 5:
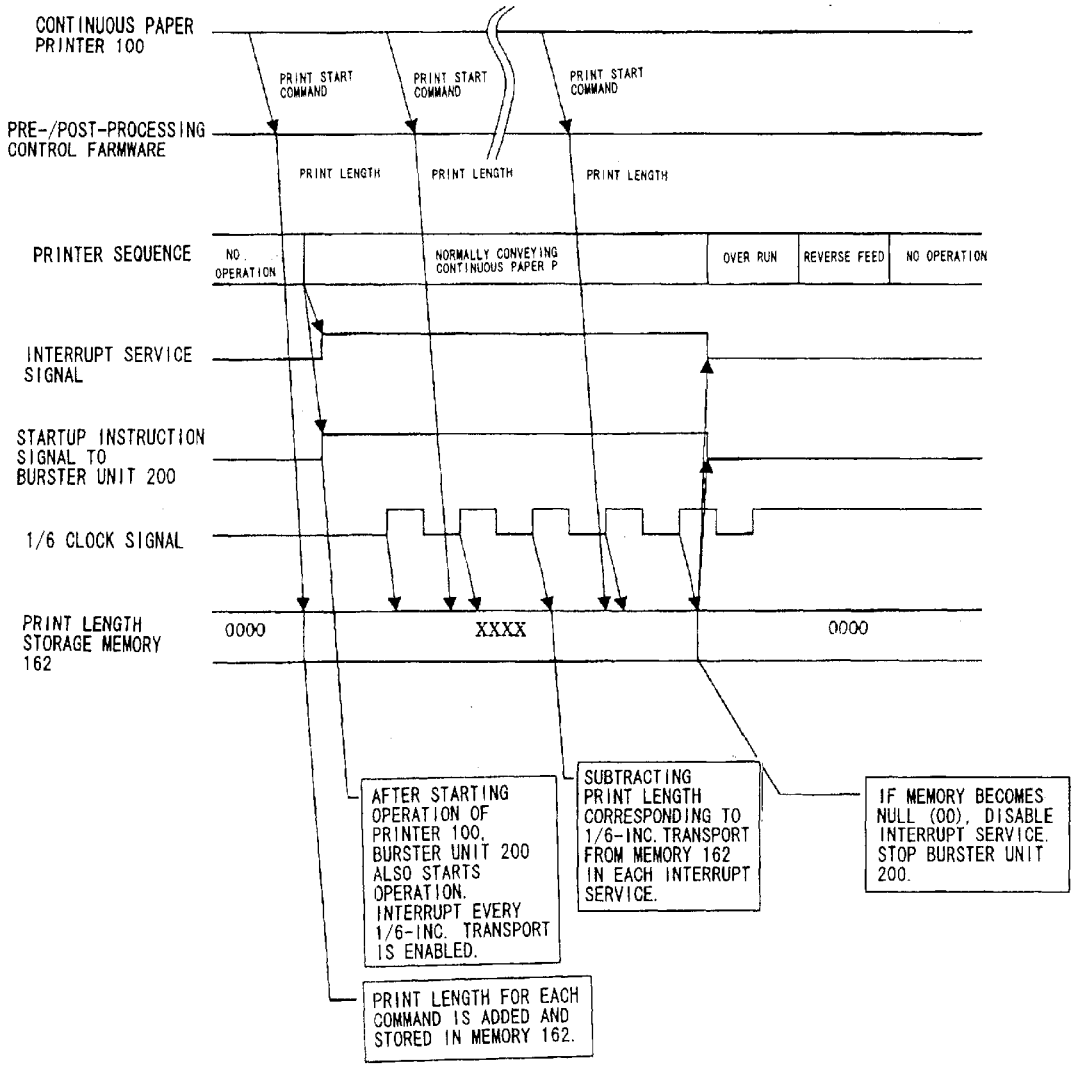
FIG. 5 is a time chart for explaining an operation shown in the flowchart in FIG. 4 with respect to an operating time.

Hereinafter, a description will be given of a method of controlling the burster unit 200 with reference to FIGS. 4 and 5. FIG. 4 is a flowchart for explaining the method of controlling the burster unit 200. FIG. 5 is a time chart for explaining an operation shown in the flowchart in FIG. 4 with respect to an operating time. In the following data, the print length corresponding to 1 inch is indicated by 60 in print length, and is measured in units of ⅙ inch (equivalent of 10 in print length).

When the host device provides a print command (step 302), the controller 150 in the continuous paper printer 100 receives the same, and transmits the print start command and print length data for the first page. The mechanical controller 160 receives the print start command for the first page (step 304), and stores the print length data in the print length storage memory 162 (step 306). Thereafter, the printing mechanism 170 and conveyor mechanism 180 get started and initiate a printing operation (step 308). If the printing has not yet been initiated (step 310), the printing operation starts its operation. If the printing has already been initiated (step 310), the ⅙-inch interrupt circuit 164 starts its operation, and interrupt service signals every ⅙-inch transport are enabled (step 312). The burster unit 200 is then enabled (step 314). Subsequently, when a ⅙-inch clock signal is generated from the mechanical controller 160, and a startup instruction signal for the burster unit 200 is enabled (as shown in FIG. 5), the burster 200 starts a conveying operation.

Next, if no command for printing the next and following pages is provided, the mechanical controller 160 does not receive a print start command (step 316). Then, if no interrupt service every ⅙-inch transport has been carried out (step 320), the continuous paper printer 100 and the burster unit 200 both continue their operations. If the interrupt service every ⅙-inch transport has been carried out (step 320), the length corresponding to ⅙ inch is subtracted from the print length stored in the print length storage memory 162 every ⅙-inch clock (step 322).

Alternatively, if a command for printing the next and following pages is provided, the mechanical controller 160 receives a print start command for the next and following pages (step 316). Then, a new print length is added to the print length storage memory 162 (step 318). Next, if no interrupt service every ⅙-inch transport has been carried out (step 320), the continuous paper printer 100 and the burster unit 200 both continue their operations. If the interrupt service every ⅙-inch transport has been carried out (step 320), the length corresponding to ⅙ inch is subtracted from the print length stored in the print length storage memory 162 every ⅙-inch clock (step 322).

After the step 322, if the print length stored in the print length storage memory 162 does not become zero (step 324), the steps 316 to 322 are repeated until the print length becomes zero. If the print length becomes zero (step 324), it means that the printing is to be complete. Therefore, the printing mechanism 170 in the continuous paper printer stops its operation. After step 324, the interrupt service every ⅙-inch transport is disabled, and thus the burster unit 200 also stops its operation (including conveying operation) in response thereto (step 326). From then on as well, the conveyor mechanism 180 continues its operation, and conveys the continuous paper P for a distance from the transfer unit 130B to the fixing unit 140B (step 328). Accordingly, the toner image on the continuous paper P is fixed, and a sag is generated in the continuous paper P between the continuous paper printer 100 and the burster unit 200. Then the continuous paper P is conveyed for a distance from the fixing unit 140B to the transfer unit 130B in a reverse direction (step 330). Thereafter, the continuous paper printer 100 stops its conveying operation (step 332). The printing is complete then (step 334).

A description will be given of the steps shown in FIG. 4 in sequence. First, when the mechanical controller 160 receives a print start command for the first page (step 304), a print length for each command is added and stored in the print length storage memory 162 (step 306). At that moment, the continuous paper printer 100 and the burster unit 200 are not in operation. Subsequently, the printing mechanism 170 and the conveyor mechanism 180 in the continuous paper printer 100 initiates their operations, and the continuous paper P is conveyed in the device 100, and printing is done thereon.

Immediately after the continuous paper printer 100 starts operation, the burster unit 200 also gets ready for operation, but actually starts the conveying operation in the burster unit 200, on condition that a startup instruction signal to the burster unit 200 is enabled and that a ⅙-inch clock signal is generated. Thereafter, interrupt service is carried out every ⅙ inch in synchronism with the ⅙-inch clock, and the burster unit 200 starts its conveying operation. The interrupt service subtracts the print length corresponding to ⅙ inch for each ⅙-inch clock from the print length stored in the print length storage memory 162.

When the mechanical controller 160 stops receiving a new print start command, the print length is thereafter not added, but only subtracted repeatedly. If the subtraction is repeated, the print length stored in the print length storage memory 162 eventually becomes zero. Immediately after the print length becomes zero, the burster unit 200 stops its operation, and the ⅙-inch interrupt service is disabled. The conveyor mechanism 180 in the continuous paper printer 100 continues its operation, even if the burster unit 200 stops its operation, during necessary time for forming a sag by the reverse feed in the continuous paper P (a time period necessary for conveying the continuous paper P for a distance from the transfer unit 130A to the fixing unit 140B). Thereafter, the continuous paper printer 100 carries out the reverse feed, and stops operating. Thus, the printing operation by a print command for one job is complete.

Figure 6:
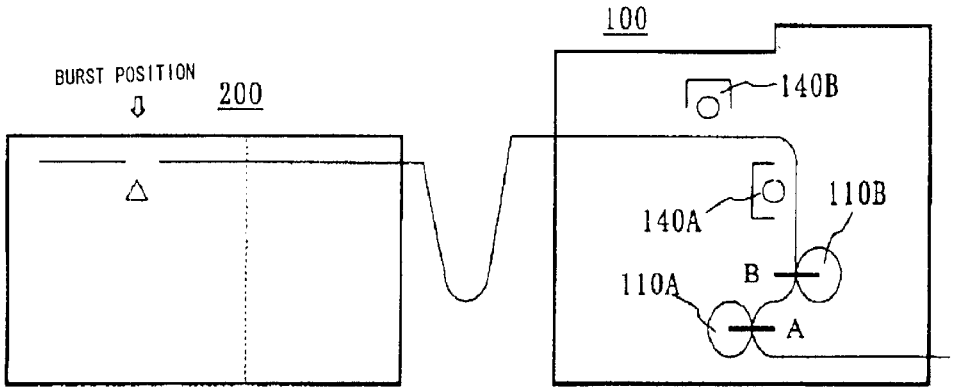
FIG. 6 is a schematic sectional view for showing a sag amount in continuous paper during printing operation.
Figure 7:
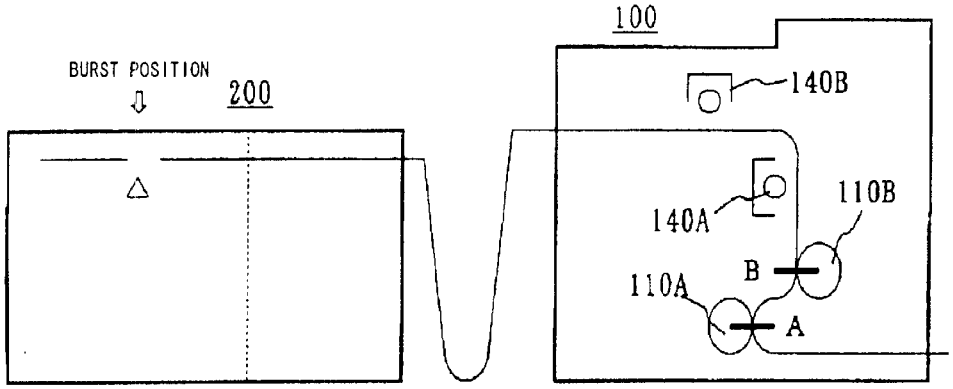
FIG. 7 is a schematic sectional view for showing a sag amount in continuous paper that has been conveyed from a transfer position to a fixing unit and is at a standstill.
Figure 8:
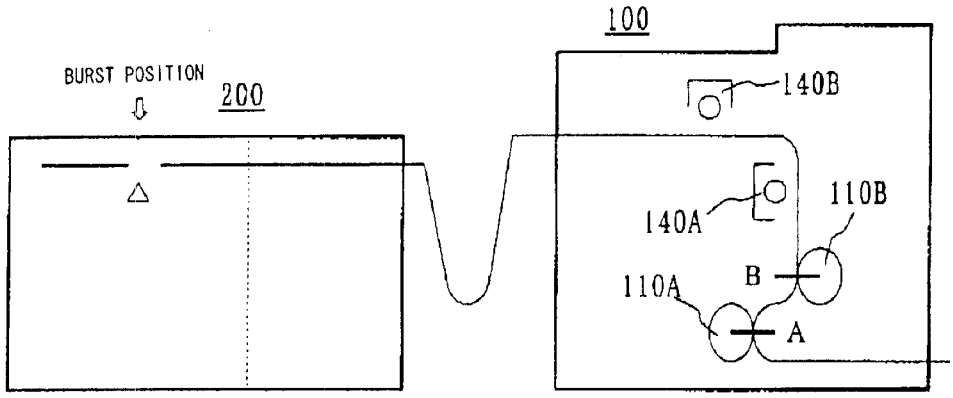
FIG. 8 is a schematic sectional view for showing a sag amount in continuous paper after a reverse feed.
Figure 9:
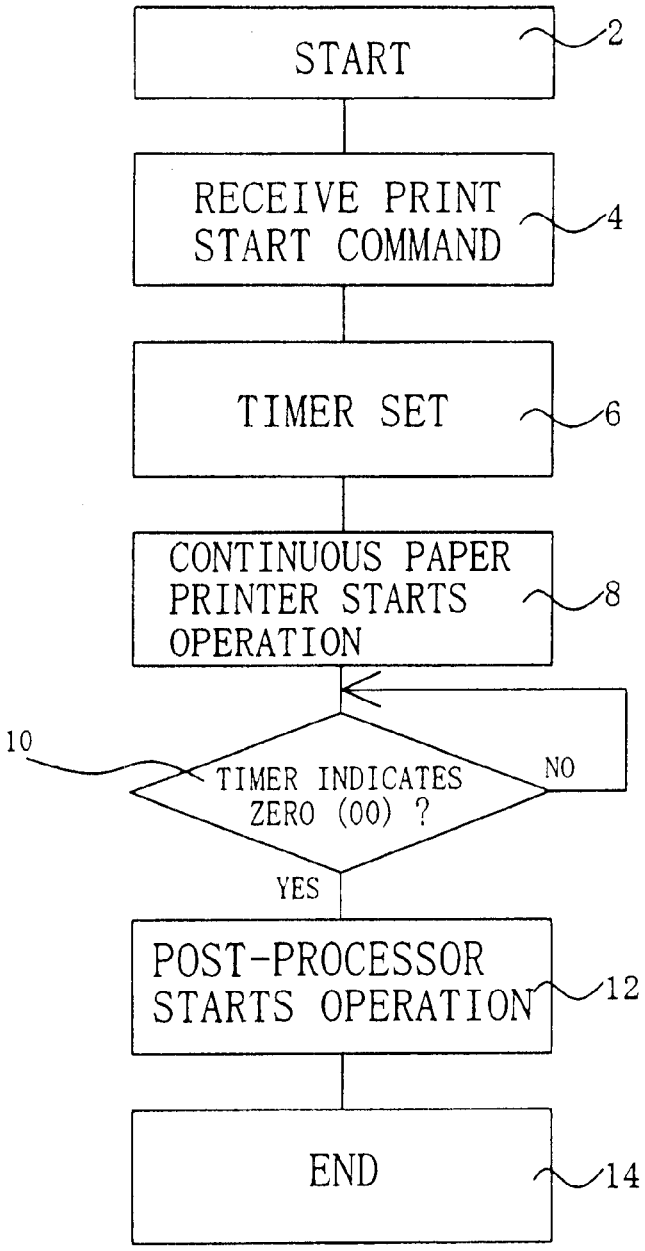
FIG. 9 PRIOR ART
FIG. 9 is a flowchart for explaining a conventional method of controlling a post-processor by showing a conventional method of controlling the printing operation.

Referring now to FIGS. 6 through 8, a description will be given of a relationship between the printing operation and a sag amount in the continuous paper P. FIG. 6 is a schematic sectional view for showing a sag amount in the continuous paper P during printing operation. FIG. 7 is a schematic sectional view for showing a sag amount in the continuous paper P conveyed from the transfer position A to the fixing unit 140B while the printing operation is at a standstill. FIG. 8 is a schematic sectional view for showing a sag amount in the continuous paper P after a reverse feed.

As described above, if the printing operation is initiated, the burster unit 200 starts operation at substantially the same time as the continuous paper printer 100. Assume that the conveying speeds of the continuous paper printer 100 and the burster unit 200 are the same. Accordingly, as shown in FIG. 6, the sag amount in the continuous paper between the continuous paper printer 100 and the burster unit 200 keeps the same level all the while as was before operation started.

As described above, when a print command for one job is complete, if no print command for the next job is provided, the burster unit 200 stops the conveyance and cutting operation, and the continuous paper printer 100 only carries out the operation of conveying the continuous paper P. The continuous paper printer 100 conveys the continuous paper P from the transfer position A to the fixing unit 140B to fix a toner image on the continuous paper P. On the other hand, the burster unit 200 does not convey the continuous paper P, and thus a sag amount in the continuous paper P increases between the continuous paper printer 100 and the burster unit 200, as shown in FIG. 7. In FIG. 7, the sag amount in the continuous paper P reaches a maximum.

Subsequently, the continuous paper printer 100 conveys the continuous paper P from the fixing unit 140A to the transfer position A in a reverse direction, that is, carries out a reverse feed to get ready for the next job. This reduces the sag amount in the continuous paper P. Therefore, after the reverse feed, the sag amount in the continuous paper as shown in FIG. 8 decreases to the same level as that during printing operation as shown in FIG. 6. As readily understood from FIGS. 6 through 8, it is only immediately before the reverse feed step that the sag amount in the continuous paper P exhibits the maximum value. As a result, the state that the sag amount in the continuous paper P exhibits an excessively increased value does not last, and thus the time during which the printed image formed on the continuous paper P is in contact with a floor or a saucer can be shortened.

According to the method of controlling the post-processor 200, a sag in the continuous paper P for a reverse feed is provided before the reverse feed step, and thus during printing operation, the continuous paper P is kept from a contact with a floor or a saucer, thereby preventing image quality deterioration or dirty continuous paper P from resulting. Moreover, reduced influences of a wind from outside, or the like on the continuous paper P would provide stable transport of the continuous paper P, and high quality image formation. Further, the inventive control method can find out a reverse feed amount in advance from the structure of the image-forming device 100 in use, to determine a sag amount in the continuous paper P considering the reverse feed amount, and is thus suitable for a variety of the image-forming devices 100 each having varied reverse feed amounts.

Although the preferred embodiments of the present invention have been described above, various modifications and changes may be made in the present invention without departing from the spirit and scope thereof. For instance, the present invention is also applicable to an integrated image-forming unit in which the image-forming device and the post-processing unit are combined.

As described above, the method of controlling the post-processor connected with the image-forming device according to the present invention is configured to initiate conveying operations in the image-forming device and the post-processor approximately simultaneously, and then to stop the conveying operation in the post-processor prior to that in the image-forming device, thereby provide a specified sag in the continuous paper. Accordingly, concern for unstable sag formation in the continuous paper that has always caused a distress is no longer required, and contact of the continuous paper with a floor or a saucer may be prevented invariably. Consequently, the present invention makes it possible to form a high-quality image.

The control method according to the present invention may employ a conventional image-forming device and post-processor without any addition or modification, and thus be introduced easily. Furthermore, the inventive control method can accommodate wide-ranging alterations and modifications such as of the reverse feed amount, and the size of the continuous paper.

What is claimed is:

1. A method of controlling a post-processor by an image-forming device that includes a transfer part and a fixing part, and conveys continuous paper, said image-forming device being connected with said post-processor that processes the continuous paper on which an image has been formed, wherein said method comprises the steps of:

initiating an electrophotographic image-forming operation in the transfer part and the fixing part so that said image-forming device forms an image onto and conveys the continuous paper;

initiating an operation of the post-processor so that the post-processor post-processes and conveys the continuous paper;

stopping the operation of said post-processor on or before a completion of a transfer by the transfer part onto the continuous paper;

conveying to the fixing part the continuous paper onto which the transfer part has finished transferring; and conveying to the transfer part the continuous paper onto which the fixing part finishes a fixation.

2. A method according to claim 1, further comprising the step of validating a startup instruction signal to said post-processor, in response to a print start command, wherein said step of initiating the operation of said post-processor comprises the step of activating said post-processor in response to said startup instruction signal.

3. A method according to claim 2, wherein said print start command is received for each printing page.

4. A method according to claim 1, further comprising the steps of:

obtaining a print length of said image; and subtracting a pre-determined amount from said print length;

wherein said step of initiating said operation of said post-processor comprises the step of initiating a conveying operation of said post-processor after said subtracting step.

5. A method according to claim 4, further comprising the steps of:

judging whether said print length has become zero as a result of said subtracting step; and generating an inactive signal if judging that said print length has become zero in said step of judging, wherein said step of stopping said operation of said post-processor comprises the step of stopping said conveying operation of said post-processor in response to said inactive signal.

6. A method according to claim 4, wherein said predetermined amount is a specific amount of said continuous paper that has been conveyed.

7. A method according to claim 4, wherein said step of subtracting utilized an interrupt service carried out at specific intervals.

8. A method according to claim 4, wherein said step of obtaining said print length of said image comprises the step of adding each print length identified in a print start command received for each printing page.

9. An electrophotographic image-forming device comprising:

a mechanical controller which controls a printing mechanism that forms an image, and a conveyor mechanism that conveys a continuous paper; and a main controller that controls said mechanical controller, wherein said main controller controls said mechanical controller so as to generate a signal for stopping a conveyance by a post-processor connected with said image-forming device a specified time before said conveyor mechanism stops.

10. An image-forming device according to claim 9, wherein said printing mechanism includes a transfer part and a fixing part, and said specified time corresponds to a conveyance of said continuous paper from said transfer part to said fixing part.

11. An image-forming device according to claim 9, wherein said printing mechanism comprises:

a first transfer part that follows a transfer step to one side of said continuous paper;

a first fixing part that corresponds to said first transfer part;

a second transfer part that follows a transfer step to the other side of said continuous paper; and a second fixing part that corresponding to said second transfer part, wherein said specified time corresponds to a time period that is required to convey said continuous paper from said first transfer part to said second fixing part.

* * * * *